US010350908B2

(12) United States Patent
Ficarra et al.

(10) Patent No.: US 10,350,908 B2
(45) Date of Patent: Jul. 16, 2019

(54) SYSTEM FOR PRINTING ON THREE-DIMENSIONAL (3D) OBJECTS

(71) Applicant: Xerox Corporation, Norwalk, CT (US)

(72) Inventors: Richard P. Ficarra, Williamson, NY (US); Christine A. Steurrys, Williamson, NY (US); Robert E. Rosdahl, Jr., Ontario, NY (US); Robert R. Reed, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 345 days.

(21) Appl. No.: 15/233,044

(22) Filed: Aug. 10, 2016

(65) Prior Publication Data

US 2018/0043702 A1 Feb. 15, 2018

(51) Int. Cl.

| | |
|---|---|
| ***B41J 3/00*** | (2006.01) |
| ***B41J 11/00*** | (2006.01) |
| ***B41J 3/407*** | (2006.01) |

(52) U.S. Cl.

CPC ..... *B41J 3/4073* (2013.01); *B41J 11/002* (2013.01)

(58) Field of Classification Search

CPC ..... B41J 3/00; B41J 3/40; B41J 3/40; B41J 3/407; B41J 3/407; B41J 3/4073; B41J 11/00; B41J 11/002

See application file for complete search history.

(56) References Cited

U.S. PATENT DOCUMENTS

| | | | | |
|---|---|---|---|---|
| 7,137,426 | B2 | 11/2006 | Neri et al. | |
| 8,557,355 | B2 | 10/2013 | Hann et al. | |
| 2002/0131062 | A1* | 9/2002 | Neri | B41F 16/00 358/1.9 |
| 2010/0119739 | A1 | 5/2010 | Beck et al. | |
| 2010/0208006 | A1* | 8/2010 | Selinfreund | G01N 35/1016 347/68 |
| 2015/0182997 | A1 | 7/2015 | Balantrapu et al. | |
| 2018/0315923 | A1* | 11/2018 | Vronsky | B41J 29/02 |

* cited by examiner

*Primary Examiner* — Seyed Masoud Malekzadeh
*Assistant Examiner* — Matthew Hoover
(74) *Attorney, Agent, or Firm* — Maginot Moore & Beck LLP

(57) ABSTRACT

An object printing system facilitates the printing of articles of manufacture. The system includes at least one printhead, a transfer device, an ultraviolet (UV) radiator, a pressurized gas source operatively connected to the transfer device, a plurality of actuators, and a controller. The controller is configured to operate the at least one printhead to form an image on a substrate, move the substrate bearing the image past the UV radiator as the controller operates the UV radiator to cure the ejected marking material partially to prevent ink movement, and operates the pressurized gas source to conform the substrate and partially cured ejected material to a shape corresponding to a surface of an object placed on the substrate to transfer the partially cured marking material onto the surface of the object. The transfer device can be an inflatable bladder or a molded vacuum chamber.

7 Claims, 2 Drawing Sheets

SYSTEM FOR PRINTING ON THREE-DIMENSIONAL (3D) OBJECTS

TECHNICAL FIELD

This disclosure relates generally to a system for printing on three-dimensional (3D) objects, and more particularly, to systems for printing such objects using a transfer member.

BACKGROUND

Current production printing utilizes known techniques, such as two-dimensional (2D) printing technology, to print image content on objects. In order to print customized image content on a portion of 3D object, the printheads have to be maneuvered to present the object portion to be printed as a parallel plane to the printheads. Additionally, curved or irregular surfaces are difficult to print with a plane of printheads because the gap between the ejectors in the printheads and the surface of the object differ with reference to the curvature or elevation changes in the surface. The differences in gaps between the ejectors and the surface can be enough to affect the registration of the printing since some drops of material travel further than other drops of material. Consequently, air turbulence can affect the movement of the drops that travel further or the ejector can be slightly angled in the printhead. This latter defect is not as noticeable for drops travelling shorter distances than it is for drops travelling longer distances. Also, the shape of a drop of ink varies as it moves through the gap between a printhead and a part. Consequently, gap size can affect whether a drop is properly shaped, forms a satellite drop, is improperly shaped, or becomes multiple drops as it lands on the object. These and other known effects prevent many objects, particularly curved or irregular objects, from being printed by previously known printers.

Transfer printing of three-dimensional objects with photo-resist materials has been tried. In these previously known systems, an image is printed on a sheet with photo-resist materials that are curable with ultraviolet (UV) radiation. The sheet is then placed against the surface of the object and then pressed against the object or vacuum is applied between the sheet and the object to draw the sheet against the object. The back of the sheet is radiated with UV radiation to cure the photo-resist material. When the sheet is removed from the object, the photo-resist remains on the object surface and the surface can then be etched to form the pattern in the surface of the object. Alternatively, the photo-resist pattern on the object surface can act as a plating resist to preserve the covered areas when the object is plated. Afterwards, the photo-resist material is removed.

This approach uses UV radiation to transfer the photo-resist image to the object because heat and pressure transfer of an image from a sheet fails to register the image appropriately on the surface. Waiting until the sheet is in contact with the object surface, however, requires the use of particular types of ink to avoid ink movement or uncured ink mixing before the sheet contacts the object surface. For example, differences in surface energy between drops of UV curable inks and the surface on which they land can cause the drops to move after they have landed. This movement can produce holes in areas where the coverage is supposed to be continuous or cause drops of different colors to mix and form unintended colors that can adversely impact the quality of the image. To address these issues, the previously known 3D object printing systems used UV inks that have a high enough percentage of wax in the ink that the ink is solid at room temperature. By melting the ink and ejecting it to form a photo-resist pattern, the pattern stabilizes as it cools, which commences as soon as the ink is ejected. Being able to use UV inks that do not have to be solid at room temperature would be useful.

Other transfer image systems use sheets pre-printed with dye inks to avoid the issues related to ink movement and color mixing. The pre-printed sheets having fixed images on them, however, require that the sheets be heated once the sheet is applied to the object surface to release the fixed ink image from the sheet so it can be transferred by pressure. This type of previously known system requires that the image sheet preparation be a separate process from the object printing since the image must be fixed on the sheet so the sheet can be manipulated and conform to the object surface for image release. Thus, a printer that enables reliable printing of curved 3D object surfaces using a broad array of inks without requiring a separate image sheet printing process is desirable.

SUMMARY

A printing system that enables the printing of curved or irregularly shaped 3D objects includes at least one printhead configured to eject marking material, a transfer device, a transport conveyor configured to move a substrate past the at least one printhead and to the transfer device, an ultraviolet (UV) radiator, a pressurized gas source operatively connected to the transfer device, a plurality of actuators, and a controller operatively connected to the plurality of actuators, the at least one printhead, the pressurized gas source, and at least one UV radiator. The controller is configured to operate one of the actuators to operate the transport conveyor and move the substrate past the at least one printhead as the controller operates the at least one printhead to eject marking material onto the substrate, move the substrate and the ejected marking material past the UV radiator as the controller operates the UV radiator to cure the ejected marking material partially, and move the substrate to the transfer device, the controller also being configured to operate the pressurized gas source to conform the substrate and partially cured ejected material to a shape corresponding to a surface of an object placed on the substrate to transfer the partially ejected marking material onto the surface of the object.

A method of operating a printing system to print images on curved or irregularly shaped 3D objects includes operating with a controller a first actuator in a plurality of actuators to operate a transport conveyor and move a substrate on the transport conveyor past the at least one printhead, operating with the controller at least one printhead to eject marking material onto the substrate as the substrate moves past the at least one printhead, continuing to operate with the controller the first actuator to move the substrate and the ejected marking material past an ultraviolet (UV) radiator, operating the UV radiator with the controller to cure the ejected marking material partially as the substrate and ejected marking material move past the UV radiator, continuing to operate the first actuator with the controller to move the substrate to a transfer device, and operating with the controller a pressurized gas source that is operatively connected to the transfer device to conform the substrate and partially cured ejected material to a shape corresponding to a surface of an object placed on the substrate to transfer the partially ejected marking material onto the surface of the object.

BRIEF DESCRIPTION OF THE DRAWINGS

The foregoing aspects and other features of a printing system that prints images on 3D objects are explained in the following description, taken in connection with the accompanying drawings.

DETAILED DESCRIPTION

Figure 1:
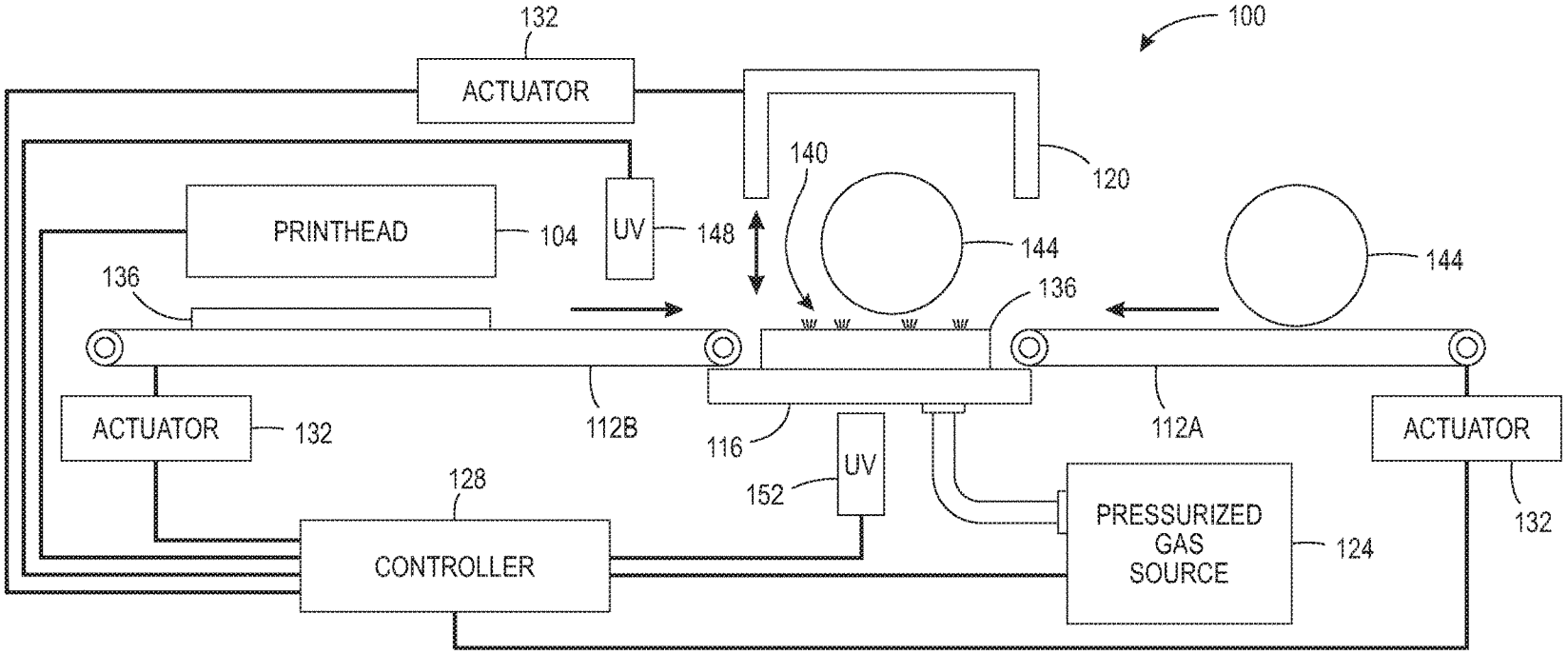
FIG. 1 illustrates a system 100 configured to transfer a printed image onto a 3D object.

For a general understanding of the present embodiments, reference is made to the drawings. In the drawings, like reference numerals have been used throughout to designate like elements.

FIG. 1 illustrates one embodiment of a system 100 configured to transfer printed images onto a 3D object. The system 100 includes one or more printheads 104, transport conveyors 112A and 112B, an inflatable transfer device 116, a transfer chamber 120, a pressurized gas source 124, a controller 128, one or more actuators 132, and ultraviolet (UV) radiators 148 and 152. The controller 128 is configured with programmed instructions stored in a memory operatively connected to the controller so the controller can execute the programmed instructions to operate components in the system 100. Thus, the controller 128 is operatively connected to the actuators 132, the printhead(s) 104, the pressurized gas source 124, and UV radiators 148 and 152, and is configured to operate these components as described below.

The controller 128 operates the actuator 132 operatively connected to the transport conveyor 112B to pass a substrate 136 past the printhead(s) 104 as the controller 128 operates the printhead(s) 104 to form an ink image 140 on the substrate 136. The substrate 136 is a sheet of material that is flexible enough to conform to irregularities in a 3D object surface without breaking or tearing. The material is also enables the passage of UV radiation as explained below. Such materials can be any material that can be used as a shrink wrap and include polyolefin, PVC, polyethylene, and polypropelene. The controller 128 continues to operate the actuator 132 operatively connected to the transport conveyor 112B to move the substrate 136 bearing the ink image past the UV radiator 148 while the controller operates the UV radiator 148 to radiate the ink image 140 on the substrate 136. The controller 128 operates the UV radiator 148 and actuator 132 to cure the UV inks forming the ink image only partially. This partial curing of the UV inks helps control ink movement and reduces the risk of color mixing in the image as the substrate 136 is manipulated by the transfer device 116 during transfer of the image onto the object 144. After the image is partially cured, the conveyor 112B is operated to move the substrate 136 having the image 140 onto the inflatable transfer device 116.

The transfer device 116 is an inflatable structure made of a material that is flexible enough to conform to irregularities in a 3D object surface without breaking or tearing. The material is also enables the passage of UV radiation as explained below. Additionally, the material has to be resilient enough to be capable of repeated inflations and deflations without failure. Such materials include clear synthetic rubber. In one embodiment, the transfer device 116 is an inflatable bladder.

Once a 3D object is placed on conveyor 112A, the controller 128 operates actuator 132 operatively connected to the conveyor 112A to move the object 144 onto the substrate 136 bearing the image 140 positioned on the transfer device 116. The controller 128 operates the actuator 132 operatively connected to the transfer chamber 120 to lower the chamber about the object 144. The controller 128 then operates the pressurized gas source 124 to inflate the inflatable transfer device 116 to press the substrate 136 against the object 144 to transfer the partially cured ink image from the substrate 136 onto the surface of the object 144. Because the transfer device 116 is flexible, it molds the substrate 136 to the irregularities in the surface of the object 144 as the device expands. The chamber 120 ensures the object is not pushed away from the expanding transfer device to help ensure efficient transfer of the partially cured image to the surface of the object. Once the image is transferred, the controller 128 operates the UV source 152 to finish the curing of the UV ink image on the object. After operating the pressurized gas source 124 to deflate the device 116 and return it to its original form, the controller operates the actuator 132 to move the chamber 120 away from the object so the object can be removed.

Figure 2:
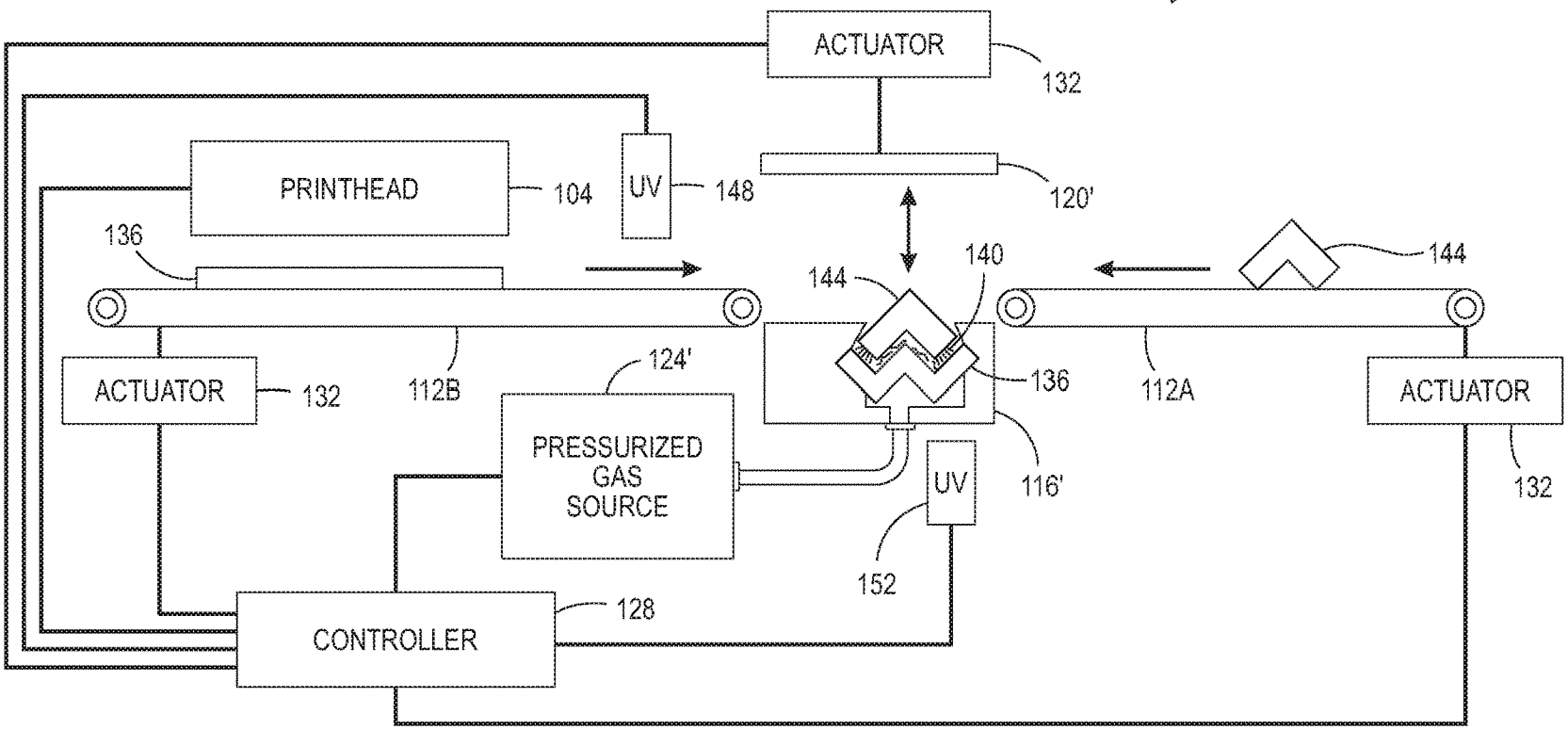
FIG. 2 illustrates an alternative embodiment 100' configured to transfer a printed image on a 3D object.

An alternative embodiment of the transfer system is shown in FIG. 2. Using like reference numbers to identify like components, the system 100' of FIG. 2 includes one or more printheads 104, transport conveyors 112A and 112B, a vacuum transfer device 116', a pressure applicator 120', a pressurized gas source 124, a controller 128, one or more actuators 132, and ultraviolet (UV) radiators 148 and 152. The controller 128 is configured with programmed instructions stored in a memory operatively connected to the controller so the controller can execute the programmed instructions to operate components in the system 100'. Thus, the controller 128 is operatively connected to the actuators 132, the printhead(s) 104, the pressurized gas source 124, and UV radiators 148 and 152, and is configured to operate these components as described below. The controller 128 operates the actuator 132 operatively connected to the transport conveyor 112B to pass a substrate 136 past the printhead(s) 104 as the controller 128 operates the printhead (s) 104 to form an ink image 140 on the substrate 136. The controller 128 continues to operate the actuator 132 operatively connected to the transport conveyor 112B to move the substrate 136 bearing the ink image past the UV radiator 148 while the controller operates the UV radiator 148 to radiate the ink image 140 on the substrate 136. The controller 128 operates the UV radiator 148 and actuator 132 to cure the UV inks forming the ink image only partially. This partial curing of the UV inks helps control ink movement and reduces the risk of color mixing in the image as the substrate 136 is manipulated for transfer of the image onto the object 144. After the image is partially cured, the conveyor 112B is operated to move the substrate 136 having the image 140 onto the vacuum transfer device 116'. The controller 128 then operates the pressurized gas source 124 to produce a vacuum in the vacuum transfer device 116' to pull the substrate 136 against the interior of the transfer device 116'. The interior of the transfer device is formed with the contours of the object 144 as a mold would be formed. In one embodiment, synthetic rubber can be molded in a shape that is complementary to the outer surface of the object and used as transfer device 116'. The synthetic rubber can be molded with holes in it to enable the vacuum to be connected to the device 116' or the holes can be bored into the device 116' after it has been molded.

When the substrate 136 is seated firmed within the interior of the transfer device 116' by the vacuum and a 3D object is placed on the conveyor 112A, the controller 128 operates actuator 132 operatively connected to the conveyor 112A to move the object 144 into the transfer device 116'. The controller 128 then operates the actuator 132 operatively connected to the pressure applicator 120' to urge the applicator against the object 144 and transfer the partially cured ink image onto the surface of the object. Because the vacuum within the transfer device 116' conforms the substrate 136 to the interior of the device 116', the substrate 136 and the image 140 fit the irregularities in the surface of the object 144. The pressure applied by the applicator 120' ensures the surface of the object engages the partially cured image for transfer of the image to the surface of the object. Once the image is transferred, the controller 128 operates the UV source 152 to finish the curing of the UV ink image on the object. After operating the pressurized gas source 124 to release the vacuum in the device 116', the controller operates the actuator 132 to move the pressure applicator 120 away from the object so the object can be removed.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An object printing system comprising:

at least one printhead configured to eject marking material;

a transfer device;

a transport conveyor configured to move a substrate past the at least one printhead and to the transfer device;

an ultraviolet (UV) radiator;

a pressurized gas source operatively connected to the transfer device;

a plurality of actuators;

a receptacle operatively connected to one of the actuators; and a controller operatively connected to the plurality of actuators, the at least one printhead, the pressurized gas source, and at least one UV radiator, the controller being configured to operate one of the actuators to operate the transport conveyor and move the substrate past the at least one printhead as the controller operates the at least one printhead to eject marking material onto the substrate, move the substrate and the ejected marking material past the UV radiator as the controller operates the UV radiator to cure the ejected marking material partially, and move the substrate to the transfer device, the controller also being configured to operate the actuator operatively connected to the receptacle to enclose the object placed on the substrate and to operate the pressurized gas source to inflate the transfer device and conform the substrate and partially cured ejected marking material to a shape corresponding to a surface of an object placed on the substrate to transfer the partially cured ejected marking material onto the surface of the object.

2. The object printing system of claim 1 further comprising:

the controller being further configured to operate the pressurized gas source to deflate the transfer device after the partially cured ejected marking material has been transferred to the surface of the object.

3. The object printing system of claim 2 wherein the transfer device is an inflatable bladder.

4. An object printing system comprising:

at least one printhead configured to eject marking material;

a transfer device;

a transport conveyor configured to move a substrate past the at least one printhead and to the transfer device;

an ultraviolet (UV) radiator;

a pressurized gas source operatively connected to the transfer device;

a plurality of actuators;

a pressure applicator operatively connected to one of the actuators; and a controller operatively connected to the plurality of actuators, the at least one printhead, the pressurized gas source, and at least one UV radiator, the controller being configured to operate one of the actuators to operate the transport conveyor and move the substrate past the at least one printhead as the controller operates the at least one printhead to eject marking material onto the substrate, move the substrate and the ejected marking material past the UV radiator as the controller operates the UV radiator to cure the ejected marking material partially, and move the substrate to the transfer device, the controller also being further configured to operate the pressurized gas source to produce a vacuum within the transfer device and conform the substrate and partially cured ejected marking material to a molded surface of the transfer device that corresponds to at least a portion of the surface of the object and to operate the actuator operatively connected to the pressure applicator to urge the object against the partially cured ejected marking material on the substrate held by the vacuum to transfer the partially cured ejected marking material to the surface of the object.

5. The object printing system of claim 4 wherein the transfer device is molded synthetic rubber and the molded surface of the molded synthetic rubber is complementary to the surface of the object.

6. The object printing system of claim 1 further comprising:

another UV radiator operatively connected to the controller; and the controller is further configured to operate the other UV radiator to finish curing the ejected material transferred to the surface of the object.

7. The object printing system of claim 1 further comprising:

another transport conveyor configured to move the object to the transfer device; and the controller is further configured to operate one of the actuators to move the object to the transfer device.

* * * * *